US006085659A

United States Patent [19]

Beukes et al.

[11] Patent Number: 6,085,659

[45] Date of Patent: Jul. 11, 2000

[54] ELECTRONIC EXPLOSIVES INITIATING DEVICE

[75] Inventors: Christo Andre Beukes, Ferndale; Vivian Edward Patz, Eastleigh; Stafford Alun Smithies, Hillcrest; Ray Frederick Greyvenstein, New Muckle Neuk; Rudy Willy Philomena Spiessens, Olifantsfortein, all of South Africa

[73] Assignee: Orica Explosives Technology Pty Ltd, Melbourne, Australia

[21] Appl. No.: 09/091,013

[22] PCT Filed: Dec. 4, 1996

[86] PCT No.: PCT/GB96/02987

§ 371 Date: Dec. 10, 1998

§ 102(e) Date: Dec. 10, 1998

[87] PCT Pub. No.: WO97/21067

PCT Pub. Date: Jun. 12, 1997

[30] Foreign Application Priority Data

Dec. 6, 1995 [ZA] South Africa ..... 95/10349

[51] Int. Cl.[7] ..... F42C 19/12; F42B 3/10

[52] U.S. Cl. ..... 102/206; 102/215; 102/200; 102/202.7

[58] Field of Search ..... 102/200, 206, 102/215, 202.5, 202.7

[56] References Cited

U.S. PATENT DOCUMENTS

| | | | |
|---|---|---|---|
| 3,258,689 | 6/1966 | Ressler et al. . | |
| 4,649,821 | 3/1987 | Marshall et al. | 102/206 |
| 4,674,047 | 6/1987 | Tyler et al. . | |
| 4,869,170 | 9/1989 | Dahmberg et al. | 102/202.5 |
| 5,214,236 | 5/1993 | Murphy et al. | 102/217 |
| 5,520,114 | 5/1996 | Guimard et al. | 102/215 |
| 5,894,103 | 4/1999 | Shann | 102/215 |

FOREIGN PATENT DOCUMENTS

| | | |
|---|---|---|
| 302136 | 10/1972 | Austria . |
| 301 848 | 2/1989 | European Pat. Off. . |
| 0 434 883 | 7/1991 | European Pat. Off. . |
| 0 588 685 | 3/1994 | European Pat. Off. . |
| 0 601 831 | 6/1994 | European Pat. Off. . |
| 0 604 694 | 7/1994 | European Pat. Off. . |
| 2 593 907 | 8/1987 | France . |
| 35 37 820 | 4/1987 | Germany . |
| 87/00256 | 1/1987 | WIPO . |
| 96/16311 | 5/1996 | WIPO . |

*Primary Examiner*—Michael J. Carone
*Assistant Examiner*—James S. Bergin
*Attorney, Agent, or Firm*—Pillsbury Madison & Sutro LLP

[57] ABSTRACT

An electronic explosives initiating device which includes a firing element which has a designed no-fire voltage and an operating circuit which operates at any voltage in a range of voltages which straddles the designed no-fire voltage.

21 Claims, 8 Drawing Sheets

ELECTRONIC EXPLOSIVES INITIATING DEVICE

This application is the national phase of international application PCT/GB96/02987 filed Dec. 4, 1996 which designated the U.S.

BACKGROUND OF THE INVENTION

This invention relates to an electronic detonator for initiating explosives and to a system which include one or more of the detonators.

The invention is concerned particularly with a system which enables detonators to be identified in the field, even though labels or identity markings on the devices may have been removed or obliterated, so that the detonators can be assigned definite time delays, wherein the integrity of the connections of the respective detonators to a blasting harness on site and under potentially live conditions can be rapidly and easily determined, and which offers a high degree of safety under live conditions to the personnel installing a blasting system.

DESCRIPTION OF PRIOR ART

Document EP-A-0588685 describes a detonator with an integrated electronic ignition module which includes a bi-directional communication circuit, an ignitor and an operating circuit. The ignitor is tested at a voltage which is substantially below a maximum non-trigger intensity threshold. The ignitor is protected against simultaneous failure of control transistors by means of a resistor. The system however does not cater for the situation which could arise if the resistor itself were to fail. The system does also not envisage the operation of the operating circuit, for firing the ignitor, at voltages which are above the maximum non-trigger intensity threshold voltage.

Document EP-A-0301848 describes a system wherein detonators are powered up individually before being loaded into blast holes, with explosives. Reliance is placed on the integrity of the electronic circuits for the prevention of accidents as well as on the fact that when an accident occurs the blasting cap would explode by itself and away from bulk explosives thereby reducing the possibility of harm to operators.

Document EP-A-0604694 describes a system wherein programming, arming, and firing sequences are controlled by a central control unit from a point of safety after a blasting system has been wired up. There is no description of the manner in which the individual detonators are tested for safety. No power is applied to the system until the whole system ha s been installed and wired to the central control unit. There is no description of operating the system at different voltage levels.

Document U.S. Pat. No. 4,674,047 describes a detonator which seemingly is preprogrammed under factory conditions with a time delay. No description is made of operating the detonator at different voltage levels.

Document U.S. Pat. No. 3,258,689 describes a fusehead testing method to determine the fire/no-fire limit of the fusehead. The technique described therein, although suited for testing carbon bridge fuseheads, is not suited for testing bridge structures produced in micro electronic processes.

SUMMARY OF THE INVENTION

An electronic detonator for initiating explosives which includes: a bridge firing element which is designed to be fired by a firing signal with a voltage which is greater than a designed no-fire voltage, a bi-directional communication circuit, and an operating circuit which is responsive at least to an operating signal at a voltage which is below the designed no-fire voltage, and which is characterised in that:

- the bridge firing element can only be fired by a firing signal with a voltage which is greater than a no-fire confirmation test voltage,
- the no-fire confirmation test voltage is less than the designed no-fire voltage,
- the operating circuit is responsive to an operating signal at a voltage which is any voltage in a first range of voltages which straddles the designed no-fire voltage,
- the operating circuit, in response to an operating signal at a voltage which is in the first range of voltages and which is below the designed no-fire voltage, being capable of generating the said firing signal for the bridge firing element but at a voltage which is less than the no-fire confirmation test voltage, and
- the operating circuit, when connected to an operating signal at a voltage which is in the said first range of voltages and which is below the designed no-fire voltage, is in a state in which identity data, pertaining to the detonator, can be transmitted to or from the bi-directional communication circuit.

The bi-directional communication circuit may operate at any voltage in a second range of voltages which straddles the designed no-fire voltage.

The designed no-fire voltage may be verified by testing one or more samples taken from a batch of electronic explosives initiating devices which are designed to be substantially the same due to the use of similar techniques in their manufacture.

Preferably the bi-directional communication circuit operates at any voltage in a range of voltages which straddles the no-fire voltage.

A unique identity or serial number may be assigned to the detonator and the operating circuit may include memory means for storing the number.

The operating circuit may be adapted automatically to transmit preprogrammed data, which may include the aforementioned number, in response to a particular interrogating signal, or after the detonator is powered up.

Preferably the operating circuit, when connected to the operating voltage, is responsive to an externally applied control signal by means of which the operating circuit can be switched to an unlinked state.

The detonator may include at least one structure, adjacent the firing element, which is more susceptible to mechanical damage than the firing element.

The firing element may be any appropriate mechanism and may, for example, be a semiconductor component, be formed by a bridge, or consist of any other suitable mechanism.

For example in the case where use is made of a bridge as the firing element one or more links which are physically less robust than the bridge may be positioned adjacent the bridge and may be monitored electrically, or in any other way, for mechanical damage. The operating circuit may for example include means for monitoring the link or links and for rendering the bridge inoperative if mechanical damage to the link or links is detected.

The detonator may include means for sensing the polarity of any electrical connection made to the device and for resolving the polarity of the connection.

The detonator may have a label attached to it which displays a number or code which corresponds to or which is based on the aforementioned unique number in the memory means. The detonator may have a label attached to it, for example on its lead wires, which is readable either electronically, mechanically or optically.

The detonator may include a sensing circuit which monitors a voltage applied to the device and which generates a warning signal if the voltage exceeds a predetermined level. Alternatively or additionally the voltage may be clamped to a level below the no-fire voltage.

The invention also extends to a blasting system which includes one or more of the aforementioned detonators and at least a first control unit which does not have an internal power source and which is adapted to record the identity data of each device connected to it in a predeterminable order.

The system may include a second control unit which is used to assign a respective time delay to each of the detonators via the first control unit. Use may be made of the identity data recorded in the first control unit in order to associate an appropriate time delay with each respective detonator.

The invention also extends to a blasting system which includes one or more of the aforementioned detonators and at least a first control unit which does not have an internal power source and which is adapted to record the identity data of each detonator connected to it in a predeterminable order.

The system may include a second control unit which is used to assign a respective time delay to each of the detonators via the first control unit. Use may be made of the identity data recorded in the first control unit in order to associate an appropriate time delay with each respective detonator.

The invention also provides a blasting system which includes a plurality of detonators, each of the aforementioned kind, each detonator including respective memory means in which identity data, pertaining to the detonator, is stored, and a respective operating circuit, control means, and connecting means, leading from the control means, to which each of the detonators is separately connectable, the control means including test means for indicating the integrity of the connection of each detonator to the connecting means, when the connection is made, and storage means for storing the identity data from each detonator and the sequence in which the detonators are connected to the connecting means.

The invention also provides a method of establishing a blasting system which includes the steps of connecting a plurality of detonators, each of the aforementioned kind, at respective chosen positions, to connecting means extending from control means, testing the integrity of each connection at the time the connection is made, storing in the control means identity data pertaining to each respective detonator and the sequence in which the detonators are connected to the connecting means, and using the control means to assign predetermined time delays to the respective detonators.

BRIEF DESCRIPTION OF THE DRAWINGS

The invention is further described by way of examples with reference to the accompanying drawings in which.

DESCRIPTION OF PREFERRED EMBODIMENT

No-fire current is a well known detonator bridge characteristic. With a well defined firing circuit such as may be implemented with the use of microchip technology the firing circuit inherently has a highly reproducible resistance and the no-fire voltage is therefore predictably related to the no-fire current. The no-fire voltage is inherent in the construction of the bridge, and does not rely on the correct functioning of any other circuits or components.

Figure 1:
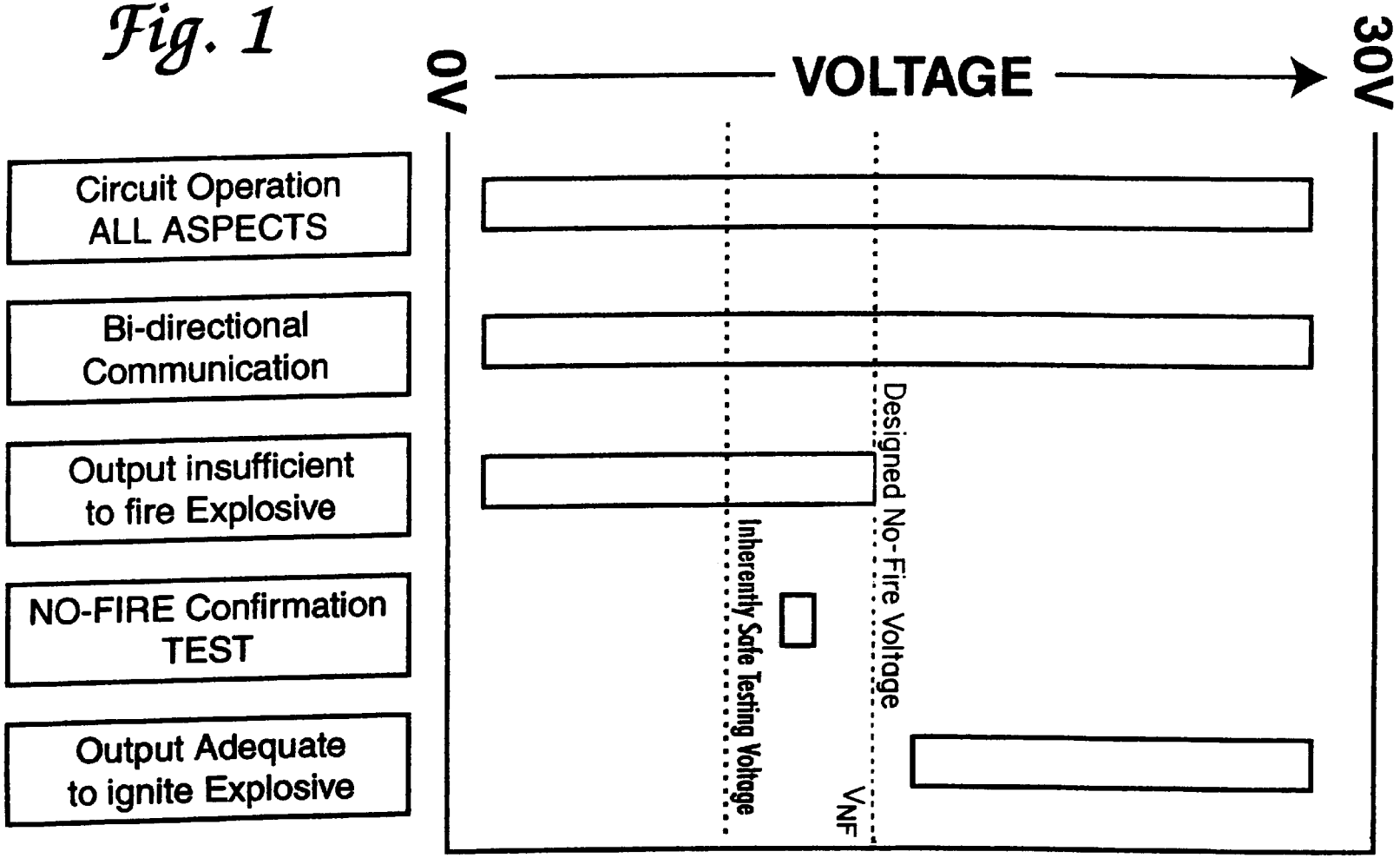
FIG. 1 is a graphical presentation of voltage characteristics of an electronic detonator according to the invention.

FIG. 1 illustrates the voltage characteristics of an electronic explosives initiating device according to the invention. The device has a designed no-fire voltage $V_{NF}$ at an intermediate level in the range of from 0 to 30 volts. Samples taken from a plurality of devices manufactured under substantially similar conditions are tested to establish a voltage at which no devices fire. The remaining devices in the batch are then assumed to have the tested no-fire voltage.

As indicated in FIG. 1 a voltage below the designed no-fire voltage is insufficient to fire the device, while above the designed no-fire voltage, the device may be ignited by sending the correct control sequences. Operating and bi-directional communication circuits, associated with the device, do however function at any voltage in a range of voltages which straddles the designed no-fire voltage and which extends from below to above the designed no-fire voltage.

The designed no-fire voltage is the voltage which is applied to the terminals of the device.

In production the designed no-fire voltage of every device produced is in fact confirmed to be above a particular limit as a result of a test that is performed on every one of the devices being produced, during which test the devices are powered up to the voltage level indicated in FIG. 1 and all circuits are operated in an attempt to fire the devices. All devices that do not fire pass the test. This ensures that any devices connected into a live circuit at the safe testing voltage will not detonate under any signal conditions.

Figure 6:
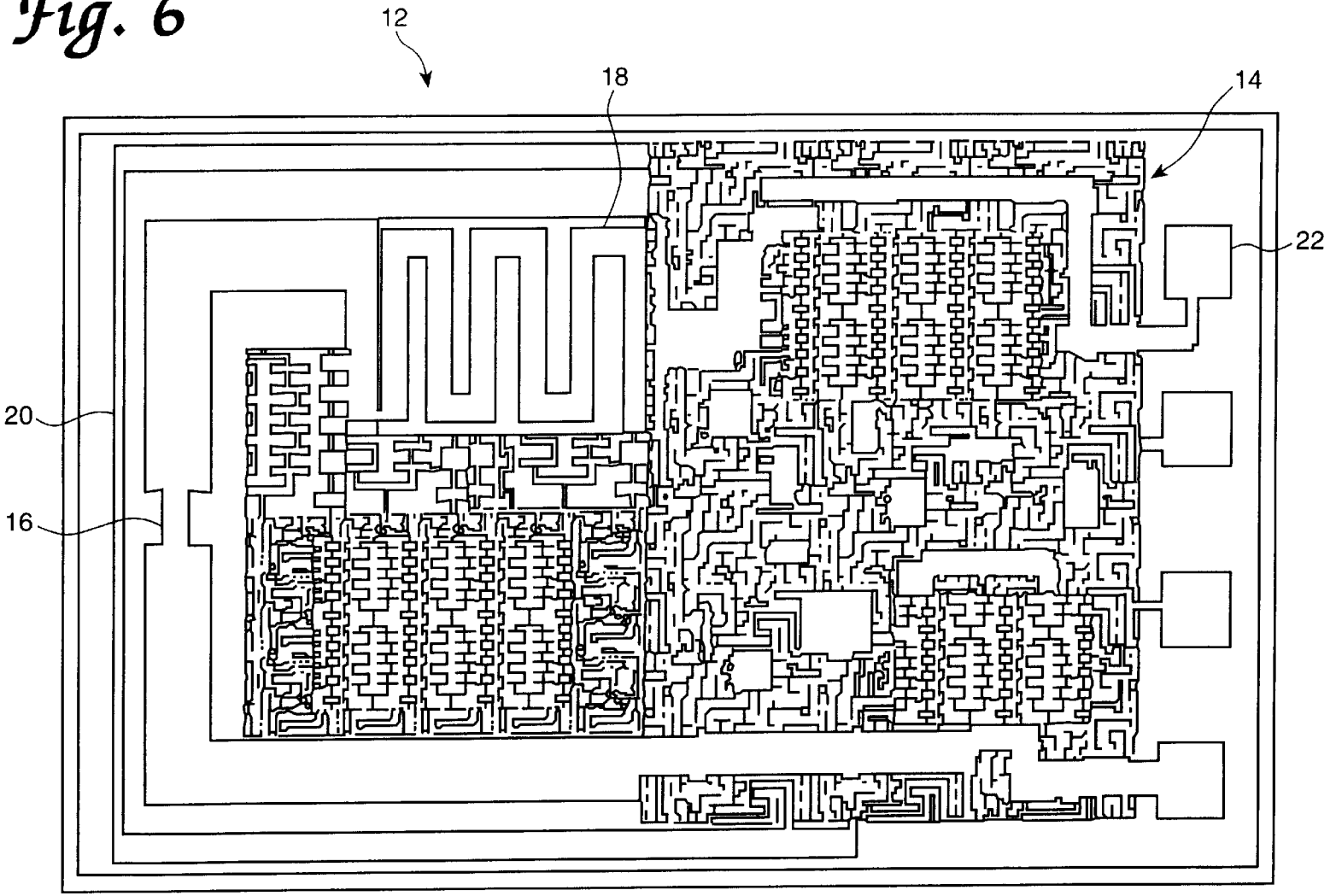
FIG. 6 is a view on an enlarged scale of an initiating device according to the invention including its associated integrated circuit.

FIGS. 2 to 5 illustrate a detonator 10 made using an electronic explosives initiating device 12 of the kind shown in FIG. 6. The last mentioned Figure shows an integrated circuit 14 with a bridge firing element 16 connected to the circuit via a firing switch 18. Adjacent the bridge firing element is a relatively thin and mechanically weaker conductor 20, used as a sensor, also referred to as a guard ring. Connections to the circuit are achieved via terminals 22.

FIGS. 2 to 5 show the mechanical relationship of the components in the detonator, and certain electrical connections. The detonator includes a tubular housing 24 in which are located an intermediate housing 26 and a base charge 28 consisting for example of PETN or TNT.

The intermediate housing carries a primary explosive 30 such as DDNP, lead styphnate, lead azide or silver azide, a header 32 a substrate 34, resistors 36 and a capacitor 38. Using bridges with enhanced output as contemplated in SA patent No. 87/3453 the intermediate housing may be filled with secondary explosives such as PETN or RDX.

Figure 4:
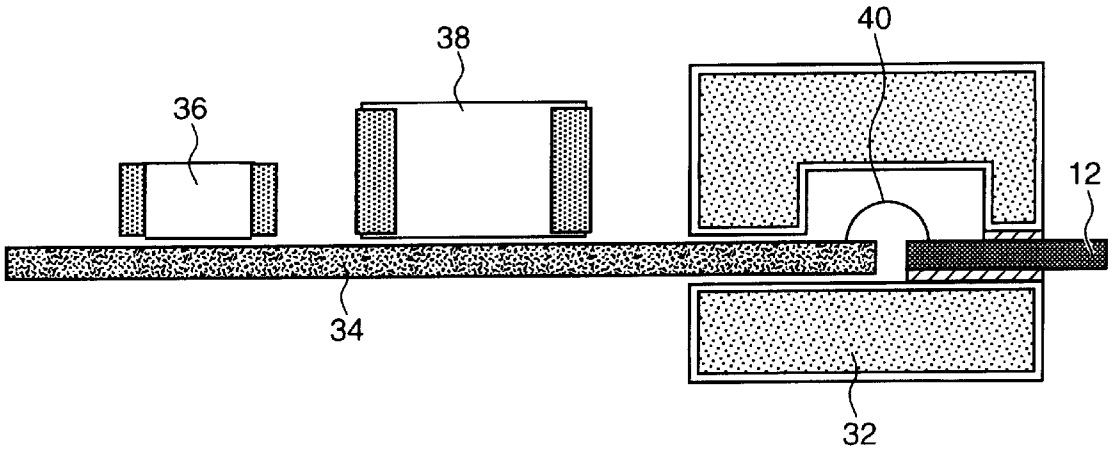
FIG. 4 is a side view of the detonator shown in FIG. 3.
Figure 5:
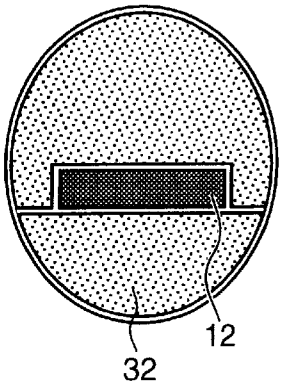
FIG. 5 is an end view of the detonator shown in FIG. 3.

The header 32 is a substrate which does not carry a circuit pattern. Located in it, however, as is more clearly illustrated in FIG. 4, is the integrated circuit 12 which constitutes the electronic explosive initiating device of the invention.

Figure 3:
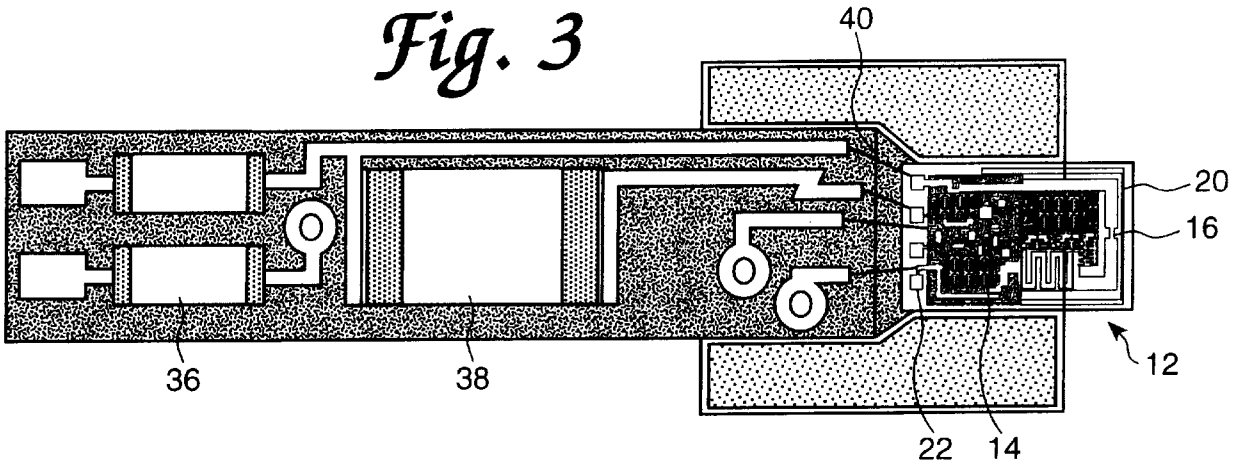
FIG. 3 is a plan view of portion of the detonator of FIG. 2, on an enlarged scale.

The substrate 34 carries a printed circuit pattern, see FIG. 3, and, as has been noted, relatively bulky components such as the resistors 36 and the capacitor 38 are mounted to the substrate.

Electrical interconnections between the header 32 and the substrate 34 are made by means of flexible bonding wires 40. Alternatively flip-chip and tape automated bonding techniques may be used to effect the electrical connections.

The housing 24 is crimped at one end 44 to a crimp plug 46 which also acts as a seal to protect the components inside the housing 24 against the ingress of moisture and dirt. Electrical leads 48 extending from the substrate 34 carry a label 50. A unique identity number associated with the detonator is carried in bar code form on the label. This number corresponds to or is associated with a number stored in the circuit 14 of the device 12.

Figure 7:
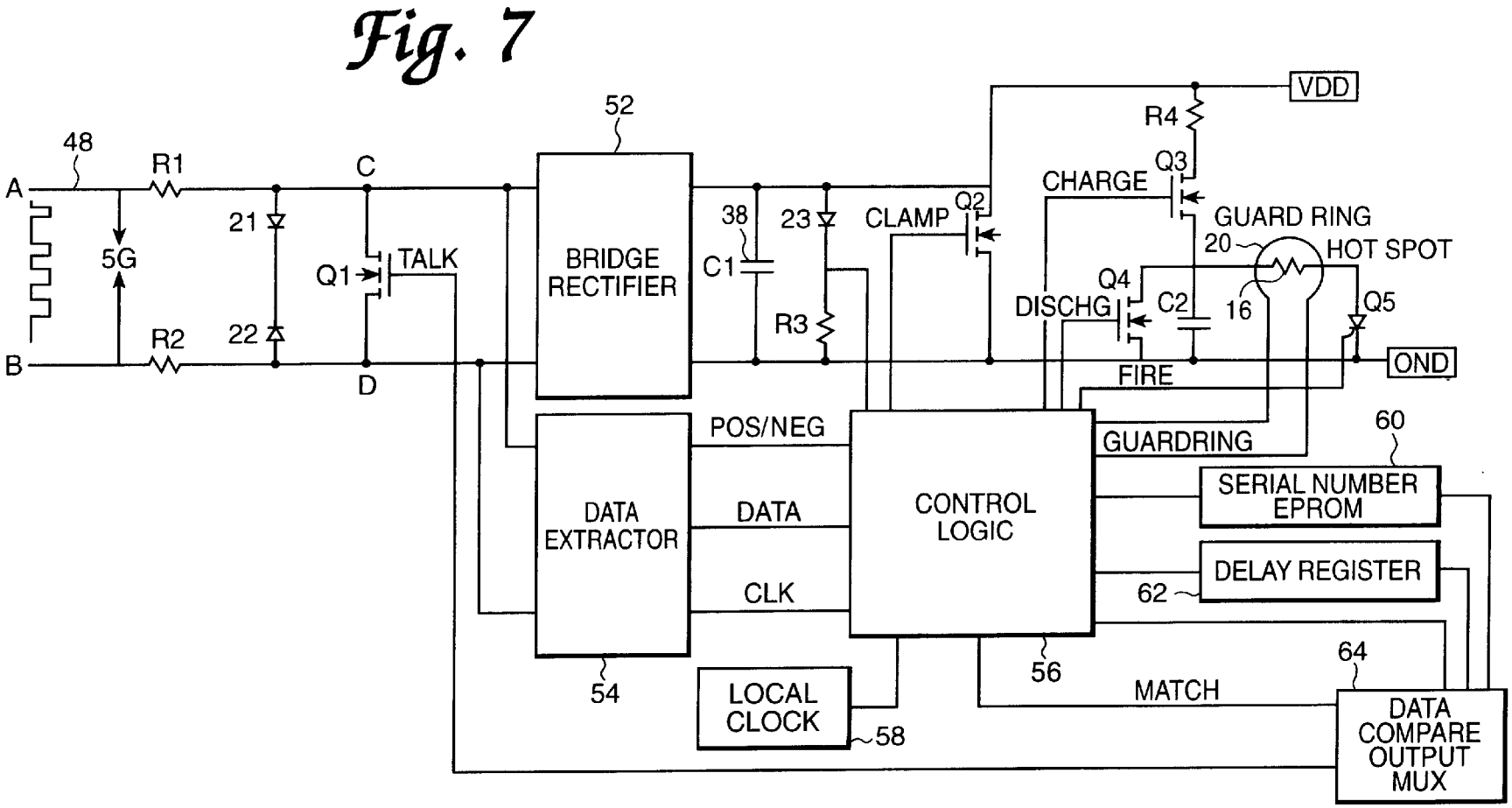
FIG. 7 is a block circuit diagram of the initiating device of the invention.

FIG. 7 is a block diagram of the circuit 14. The circuit includes the following principal components: a bridge rectifier 52, a data extractor module 54, a control logic unit 56, a local clock 58, a serial number EPROM 60, a delay register 62, and a comparator and multiplexer 64. The fusible link 16 is also illustrated as is the protective component or guard ring 20.

In the circuit shown in FIG. 7 components R1, R2, Z1 and Z2 and a sparkgap SG form an over-voltage protection circuit. The voltage between points C and D is clamped by the Zener diodes Z1 and Z2. A transistor Q1 is used to short the points C and D, drawing current through the resistors R1 and R2 during communication between the device 14 and a control unit—see FIGS. 8 and 9.

Figure 2:
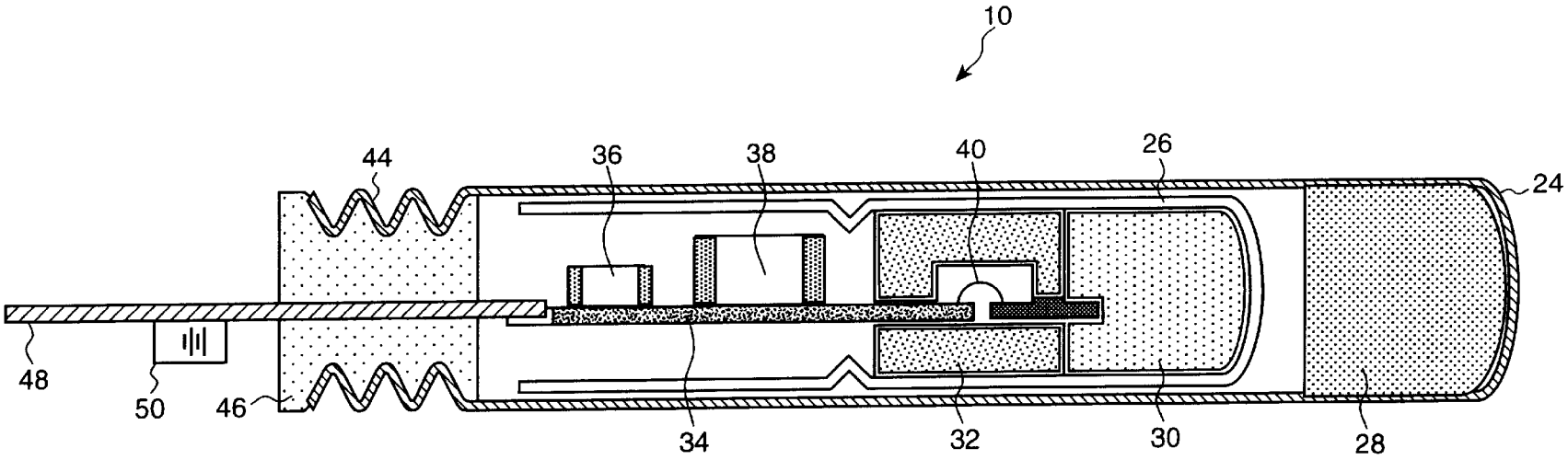
FIG. 2 is a cross-sectional view through a detonator which includes an initiating device according to the invention.

The bridge rectifier 52 rectifies the input voltage and stores energy in a capacitor C1 which corresponds to the capacitor 38 in FIG. 2. The stored energy is used for operating the circuit after signalling has ceased.

The module 54 resolves the polarity of a signal connected to input terminals A and B of the device. Data and clock are imbedded into the signals to the detonator.

A Zener diode Z3 and a resistor R3 together with the logic unit 56 are used to clamp the input voltage, using a transistor Q2, below the no-fire voltage when the device is enabled. A resistor R4 and a transistor Q3 control the charging of a firing capacitor C2. A transistor Q4 keeps the capacitor C2 discharged until charging commences.

The bridge firing element 16 is fired by charging the capacitor C2 to above the designed no-fire voltage and by then turning on a transistor switch Q5 which corresponds to the firing switch 18.

The designed no-fire voltage is the voltage across the terminals A and B for, in use, a working voltage is applied to these terminals. The voltage which appears across the element 16 will be the same as, or slightly less than, the voltage across the terminals A and B.

Figure 8:
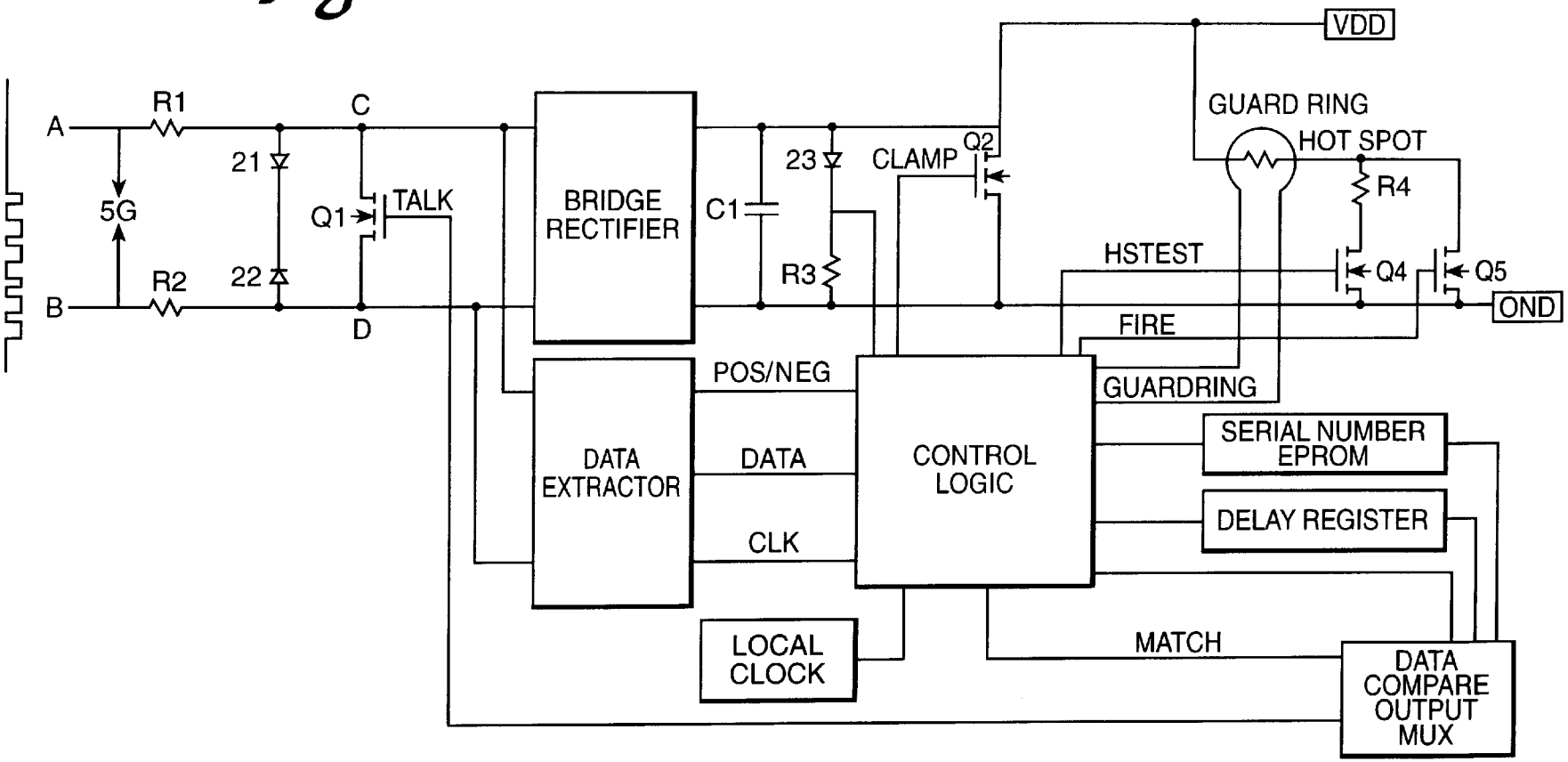
FIG. 8 is a block circuit diagram of a modified initiating device according to the invention, and FIGS. 9 and 10 respectively depict different phases in the use of a plurality of detonators in a blasting system.

The circuit shown in FIG. 8 is substantially the same as that shown in FIG. 7 save that a single capacitor C1 is used and the capacitor C2 is dispensed with. The device is tested and connected at the inherently safe voltage (FIG. 1). To fire the device, a signal is sent to disable the clamp, the voltage is raised to above the no-fire voltage, and a fire command sequence is sent.

In both circuits the guard ring 20 is connected to the control logic unit 56 so that the integrity of the firing element 16 can be monitored. This is based on the premise that the guard ring, which is less robust than the firing element 16, is more sensitive to physical or mechanical damage than the firing element. Consequently if the device 12 is subjected to physical or abrasion damage during manufacture then the guard ring 20 would be broken before the firing element. Damage to the guard ring can be assessed and the device 12 can be discarded if the guard ring is fractured.

The EPROM 60 stores a unique serial or identity number assigned to the device 12. The number corresponds to or is associated in any desirable way with the bar coded number held on the label 50. The unique number enables the device to be addressed individually. The serial number can be interrogated. At power-up a read identity command causes the linked device to respond. An unlink message unlinks a device. Unlinked devices do not respond to a read identity message. This replaces other addressing schemes eg daisy chain.

As has been indicated, the no-fire voltage of the device is established by prior testing of samples taken from a batch. The operating circuitry shown i n FIG. 7 is designed to be capable of operating over a range of voltages which straddles the no-fire voltage, see FIG. 1.

The circuit 56 is capable of bi-directional communications with a control unit which is used to control a blast sequence. As has been indicated when the device 12 is interrogated, the serial number held in the EPROM 60 can be transmitted together with any other desirable preprogrammed data to the control unit.

The integrity of the bridge 16 is monitored indirectly by monitoring the integrity of the guard ring 20. Any damage to the guard ring is automatically reported to a control unit.

It is to be noted from FIGS. 2 to 5 that the device 12 is mechanically located in the header 32 and that additional circuit components are carried on the substrate 34. The flexible bonding wires 40 which connect the substrate to the header are a particularly reliable means of connection. The flexibility and light weight of the bonding wires reduce the chance of breakage and poor electrical contact. Such movement of the device 12 relative to the header 32 and the substrate 34 may occur during manufacture, handling and use in high shock environments.

The design of the device is such that an uncoded signal of up to 500 volts, whether AC or DC, cannot be used to fire the device.

Figure 9:
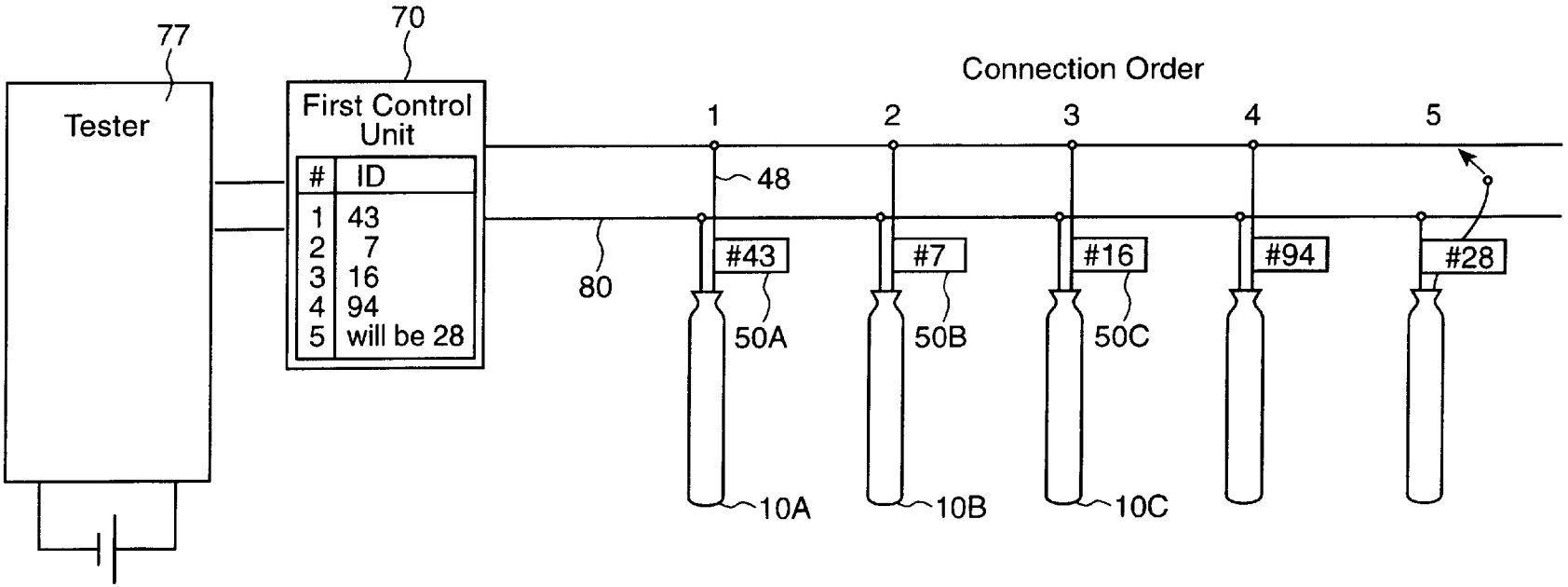
Figure 10:
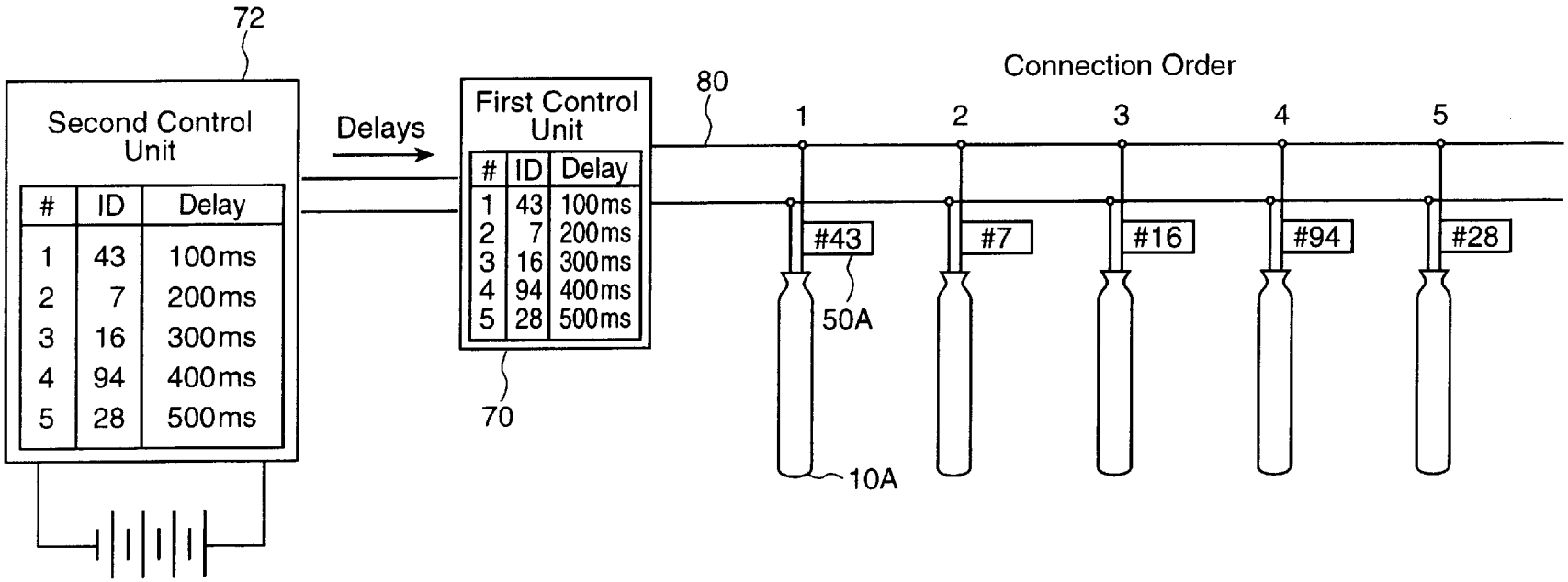

Transient overvoltages up to 30 kV will not initiate the device. FIGS. 9 and 10 illustrate the use of a plurality of devices 10A, 10B, 10C, and so on, in a blasting system. Unique numbers, associated with the respective devices, are carried on respective labels 50A, 50B, 50C, and so on. The input leads 48 of each respective device are connected to a two wire reticulation system 80, in any polarity, with the connection order being as indicated in FIGS. 9 and 10. The serial numbers on the labels are random in that they have no correlation with the connection order.

The connection order in one mode of application is monitored by, and stored in, a first control unit 70 which is powered by virtue of its connection to a tester 77 which physically contains a power source (batteries) having a maximum voltage output well below the tested no-fire voltage of the electronic explosive initiating device, thereby ensuring inherent safety during connection of the blasting system in the field. Thereafter use is made of a second control unit 72 which assigns delay periods to the detonators, taking into account their connection order, but using the serial numbers as a means for identifying the individual detonators. This enables a desired blasting sequence to be achieved in a simple yet efficient manner.

The invention makes it possible to connect detonators in the field even though labels or other identity information of the detonators may have disappeared. To achieve this each detonator has unique internally stored identification data. In order to address a detonator one must have the identity of the detonator but, to obtain the identity, the detonator must be powered up. It is therefore necessary to have a detonator with which it is safe to work at a particular voltage.

The designed no-fire voltage is the voltage across the two terminals of the detonator. As stated the designed no-fire voltage is determined from samples and each detonator which is used in a blasting system is tested beforehand at a confirmation no-fire voltage to ensure that it can be used in the field at that voltage. The operating and communicating voltages straddle the no-fire voltage. Also the detonator has the characteristic that, when powered-up, its identity data is available.

In the field, when the detonator is connected to a harness, and a good connection is made, a signal is automatically generated to indicate that the connection is in fact in order. If a signal is not generated then a technician can re-make the connection immediately. There is consequently automatic testing of the integrity of the connection. The system automatically logs the temporal sequence of the connection. In a simple blasting system the temporal sequence can sometimes be equated to the geographical positions of the detonators. This however is not always necessary for positional information can be determined in any way, for example using a global positioning system which generates precise positional data which is transmitted to the control unit It is therefore possible to make available sequential or temporal information, to obtain the identity data of each detonator, and to test the integrity of the connection of each detonator to a blasting system. Thereafter the control unit can be used, taking into account the detonator sequence, and the position of each detonator, to assign time delays to the individual detonators in order to achieve a desired blasting pattern.

The time delays can be generated using an algorithm or any appropriate computer programme which takes into account various physical factors and the blast pattern required.

As pointed out when a detonator is powered-up it is linked and specific information relating to that detonator can be sent to it from a control unit to enable the detonator to be programmed with time delay information. The detonator is subsequently unlinked and, in this state, together with all the remaining detonators in the system which are also unlinked, can receive broadcast messages, for example to fire the detonators.

At any time a detonator can be linked. This is achieved by sending the message down the line with the identity of the detonator in question.

A principal benefit of the invention is the inherent flexibility in the, blasting system. As the integrity of each connection is monitored immediately remedial action can be taken on site as required. Each detonator can be identified even if external markings are obliterated. Sequential connection information, and identity data relating to each detonator, are available automatically. Position information can be generated with ease. Consequently there are no practical constraints in assigning time delays to the individual detonators, by means of a suitable computer programme or algorithm, to achieve-a desired blast pattern.

Another significant benefit arises from the safety which is afforded to personnel installing the system. The screening which takes place, by testing off-site, at the confirmation no-fire voltage, the use of operating and communication circuits which function at voltages below the no-fire voltage of each device, and the ability of each device to "identify" itself, establish a high intrinsic level of safety in a blasting system.

We claim:

1. An electronic detonator for initiating explosives which includes:

a bridge firing element which is designed to be fired by a firing signal with a voltage which is greater than a designed no-fire voltage ($V_{NF}$), a bi-directional communication circuit, and an operating circuit which is responsive at least to an operating signal at a voltage which is below the designed no-fire voltage ($V_{NF}$), and wherein the bridge firing element can only be fired by a firing signal with a voltage which is greater than a no-fire confirmation test voltage, the no-fire confirmation test voltage is less than the designed no-fire voltage ($V_{NF}$), the operating circuit is responsive to an operating signal at a voltage which is any voltage in a first range of voltages which straddles the designed no-fire voltage ($V_{NF}$), the operating circuit, in response to an operating signal at a voltage which is in the first range of voltages and which is below the designed no-fire voltage ($V_{NF}$), being capable of generating the said firing signal for the bridge firing element but at a voltage which is less than the no-fire confirmation test voltage, and the operating circuit, when connected to an operating signal at a voltage which is in the said first range of voltages and which is below the designed no-fire voltage, is in a state in which identity data, pertaining to the detonator, can be transmitted to or from the bi-directional communication circuit.

2. A detonator according to claim 1 wherein the bi-directional communication circuit operates at any voltage in a second range of voltages which straddles the designed no-fire voltage ($V_{NF}$).

3. A detonator according to claim 1 which has a label which displays a number or code which corresponds to or which is based on the identity data.

4. A detonator according to claim 1 wherein the operating circuit, when connected to the operating signal, is responsive to an externally applied control signal by means of which the operating circuit can be switched to an unlinked state.

5. A detonator according claim 1 which includes storage means for a unique identification code associated with the detonator and terminals which are connectable to a trunkline, the operating circuit being switchable to a linked state, in which bi-directional communication can take place over the trunkline, upon receiving a first state-change signal, accompanied by the unique identification code, on the trunkline, and being switchable to an unlinked state, in which the detonator can be fired, upon receiving a second state-change signal on the trunkline.

6. A detonator according to claim 5 wherein the operating circuit is switchable to the linked state if the terminals are connected to the trunkline while a predetermined voltage is present on the trunkline or, while the terminals are connected to the trunkline, if the voltage on the trunkline is reduced below a predetermined level, and the said predetermined voltage is then applied to the trunkline.

7. A detonator according to claim 1 wherein at least one link which is physically less robust than the bridge firing element is positioned adjacent the bridge firing element and is monitored for mechanical damage.

8. A detonator according to claim 7 wherein the operating circuit monitors the link and renders the bridge firing element inoperative if mechanical damage to the link is detected.

9. A detonator according to claim 1 which includes means for sensing the polarity of any electrical connection made to the detonator and for resolving the polarity of the connection.

10. A detonator according to claim 1 which includes a sensing circuit which monitors a signal applied to the detonator, and means for limiting the voltage of the signal to a level below the designed no-fire voltage ($V_{NF}$).

11. A blasting system which includes a plurality of detonators, each detonator being according to claim 1, and at least a first control unit to which the detonators are connected and which is adapted to record at least the identity data of each detonator connected to it in a predetermined order.

12. A blasting system according to claim 11 wherein the first control unit is unable to produce a voltage which is greater than the designed no-fire voltage ($V_{NF}$).

13. A blasting system according to claim 11 which includes a second control unit which is used to assign a respective time delay to each of the detonators via the first control unit.

14. A blasting system which includes a plurality of electronic detonators, each detonator being according to claim 1, control means, and connecting means, leading from the control means, to which each of the detonators is separately connectable, the control means including test means for indicating the integrity of the connection of each detonator to the connecting means, when the connection is made, and storage means for storing the identity data from each detonator and the sequence in which the detonators are connected to the connecting means.

15. A blasting system according to claim 14 wherein the operating circuit of each detonator, when the detonator is connected to the connecting means, is placed in a linked state which allows the identity data in the detonator to be accessed by the control means.

16. A blasting system according to claim 14 wherein the storage means includes means for storing positional information relating to each respective detonator.

17. A blasting system according to claim 14 wherein the control means includes means for assigning time delays to each respective detonator.

18. A method of establishing a blasting system which includes the steps of connecting a plurality of electronic detonators, at respective chosen positions, to connecting means extending from control means, each detonator being according to claim 1, testing the integrity of each connection at the time the connection is made, storing in the control means identity data pertaining to each respective detonator and the sequence in which in the detonators are connected to the connecting means, and using the control means to assign predetermined time delays to the respective detonators.

19. A method according to claim 18 which includes the step of storing positional information, relating to each respective detonator, in the control means.

20. A method of testing and using an electronic detonator, each detonator according to claim 1, including the steps of testing the integrity of the bridge firing element by applying a firing signal which has a voltage which is lower than the designed no-fire voltage and, if the integrity of the bridge firing element is satisfactory, incorporating the detonator in a blasting system in which the detonator is fired by a firing signal with a voltage which is greater than the designed no-fire voltage.

21. A method according to claim 20 which initially includes the step of verifying the designed no-fire voltage by testing at least one sample detonator taken from a batch of electronic detonators which are designed to be substantially the same.

* * * * *

UNITED STATES PATENT AND TRADEMARK OFFICE

CERTIFICATE OF CORRECTION

PATENT NO. : 6,085,659

DATED : July 11, 2000

INVENTOR(S) : BEUKES et al.

It is certified that error appears in the above-indentified patent and that said Letters Patent is hereby corrected as shown below:

In the Drawings, Figures 7 and 8, please change reference numeral "5G" to --SG--;

change reference numeral "21" to --Z1--;

change reference numeral "22" to --Z2--; and change reference numeral "23" to --Z3--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*